United States Patent [19]

Kingston

[11] Patent Number: 4,527,718

[45] Date of Patent: Jul. 9, 1985

[54] APPARATUS FOR SHIELDING MOLTEN METAL DURING TEEMING

[75] Inventor: Michael F. E. Kingston, Kingsley, England

[73] Assignee: Air Products and Chemicals, Inc., Allentown, Pa.

[21] Appl. No.: 439,694

[22] Filed: Nov. 8, 1982

[30] Foreign Application Priority Data

Dec. 4, 1981 [GB] United Kingdom ..... 8136603

[51] Int. Cl.[3] ..... B22D 41/00

[52] U.S. Cl. ..... 222/603; 222/606; 164/437

[58] Field of Search ..... 222/607, 606, 603, 591, 222/460, 461; 164/437, 337, 438

[56] References Cited

U.S. PATENT DOCUMENTS

| | | | |
|---|---|---|---|
| 3,354,939 | 11/1967 | Calderon | 222/461 X |
| 3,592,391 | 7/1971 | Bender | 222/591 X |
| 3,838,798 | 10/1974 | Voss | 222/603 |
| 4,360,190 | 11/1982 | Ato | 222/603 X |

FOREIGN PATENT DOCUMENTS

| | | | |
|---|---|---|---|
| 2330113 | 1/1975 | Fed. Rep. of Germany | 437/ |
| 808711 | 2/1937 | France | 222/603 |
| 0020938 | 7/1979 | Japan | 222/603 |
| 834234 | 5/1960 | United Kingdom | 222/603 |
| 1564636 | 4/1980 | United Kingdom . | |

OTHER PUBLICATIONS

Babcock & Wilcox, "Kaowool Ceramic Fiber Products", 2-24-72, Product Literature.

*Primary Examiner*—Joseph J. Rolla
*Attorney, Agent, or Firm*—James C. Simmons; E. Eugene Innis

[57] ABSTRACT

An apparatus for shielding a stream of molten metal during teeming comprises a housing (106) and a ceramic ring (105). The ceramic ring (105) is made of compressible material and is tapered so that on insertion in the housing (106) it readily forms a seal with lips (107) and (113) which project inwardly from the outer wall (111) of the housing (106).

6 Claims, 3 Drawing Figures

APPARATUS FOR SHIELDING MOLTEN METAL DURING TEEMING

This invention relates to an apparatus for shielding a stream of molten metal during teeming.

Figure 1:
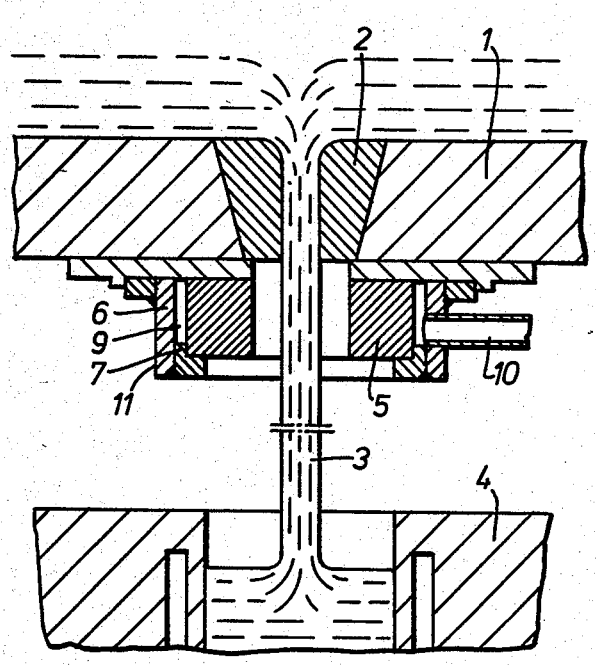
PRIOR ART FIG. 1.

UK Patent Specification No. 1,564,636 discloses an apparatus for shielding molten metal during teeming. The apparatus, which is schematically shown in FIG. 1, comprises a housing 6 which is releasably mounted on the bottom of a tundish 1 circumjacent a teeming nozzle 2. The housing 6 comprises an outer wall 11 and a lip 7 which projects radially inwardly from the bottom of the outer wall 11. The lip 7 supports an annular ceramic ring 5 so that an annular passageway 9 is defined between annular ceramic ring 5 and the housing 6. In use, an inert gas, for example nitrogen or argon, is introduced into the annular passageway 9 via a conduit 10. The inert gas diffuses through the annular ceramic ring 5 and forms an annular blanket of inert gas which surrounds the molten metal 3 being teemed and extends from the base of the teeming nozzle 2 to the top of the mould 4.

In use, molten metal splashes against the annular ceramic ring 5 thereby inhibiting the uniform flow of inert gas thereto. This necessitates frequent replacement of the annular ceramic ring 5. Whilst, at first sight, this might appear a simple operation, in practice it has proved difficult to make an effective seal between the annular ceramic ring 5 and the lip 7 of the housing 6. The present invention, at least in its preferred embodiments, reduces the difficulty in making an effective seal.

According to the present invention there is provided an apparatus for shielding a stream of molten metal during teeming, which apparatus comprises a housing which can be disposed beneath a tundish circumjacent a teeming nozzle, said housing having an outer wall and a lip which projects inwardly from the outer wall to define a circular opening, and a ceramic ring which is supported by said lip so that a passageway is defined between the ceramic ring and the housing, characterized in that the ceramic ring is tapered and is made of a compressible ceramic material, the arrangement being such that when said ceramic ring is urged through said circular opening it is compressed against said lip and forms a seal.

Preferably the housing is provided with a second lip which projects inwardly from the outer wall to define a second circular opening; the outer wall of the housing, the lips and the ceramic ring together defining the sides of a closed passageway circumjacent said ceramic ring.

Advantageously the or at least one of the lips tapers towards its circular opening.

Preferably, the wider end of the tapered ceramic ring is provided with a flange. This has the advantage that when the apparatus is secured to the bottom of a tundish it provides a greater sealing area and when the apparatus is associated with a movable launder or pivoting arm the flange protects the top of the housing of the apparatus from direct contact with molten metal.

Figure 2:
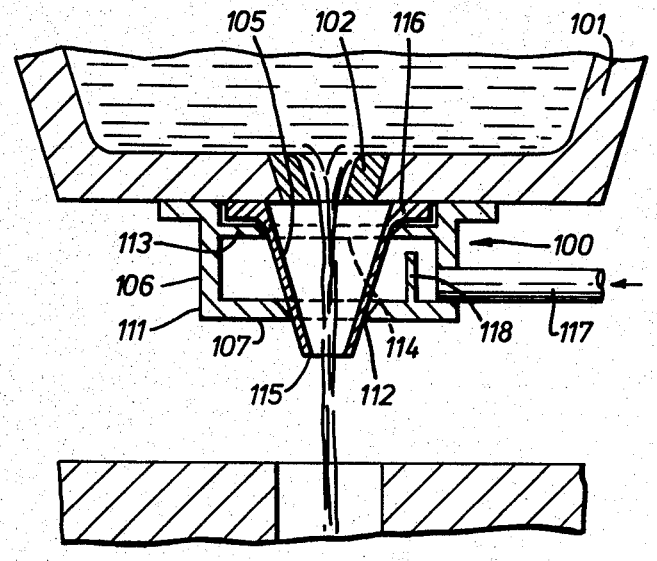
Figure 3:
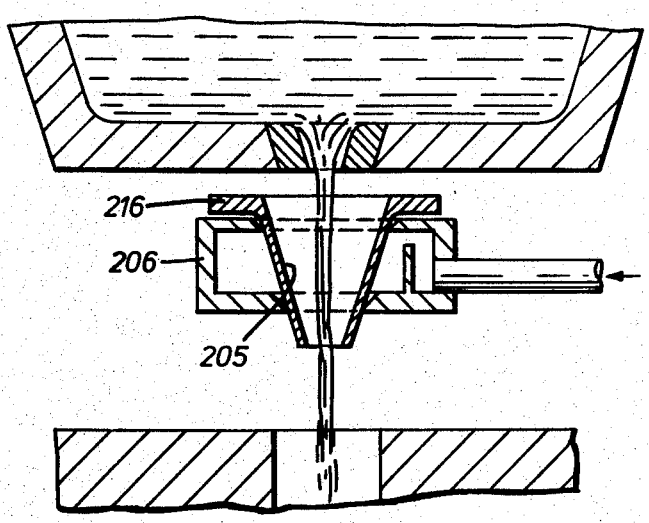

For a better understanding of the invention and to show how the same may be carried into effect, reference will now be made, by way of example, to FIGS. 2 and 3 of the accompanying drawings in which:

FIG. 2 is a schematic cross-section of one embodiment of an apparatus in accordance with the invention; and FIG. 3 is a schematic cross-section of a second embodiment of an apparatus in accordance with the invention.

Referring to FIG. 2, there is shown an apparatus for shielding a stream of molten metal during teeming which apparatus is generally identified by reference numeral 100. The apparatus 100 comprises a housing 106 which is detachably mounted on the bottom of a tundish 101 circumjacent a teeming nozzle 102. The housing 106 has an outer wall 111 and a lower lip 107 which projects inwardly from the bottom of the outer wall 111 and defines a circular opening 112. The housing 106 also has an upper lip 113 which projects inwardly from the upper portion of the outer wall 111 and defines a circular opening 114 of greater diameter than the circular opening 112. Circular openings or apertures 114, 112 are axially aligned as shown in the drawing. As can be seen in FIG. 2, the lip 107 is tapered towards the circular opening 112. Similarly lip 113 is tapered towards circular opening 114. A ceramic ring 105, having the general shape of a truncated cone, which has an integrally formed outwardly radially projecting flange 116 on its wider end, is supported by the lips 107 and 113. The ceramic ring 105 is made of a compressible ceramic material formed from, for example, Triton Kaowool standard fibre having a melting point of 1760° C. and a packing density of 250 $Kg/m^3$.

In use, argon or nitrogen is introduced into the apparatus 100 through inlet pipe 117. In order to help distribute the gas uniformly around the ceramic ring 105 a baffle 118 is positioned as shown. The baffle 118 is welded to the lower lip 107 as shown and is slightly longer than the diameter of inlet pipe 117. The argon or nitrogen diffuses through the ceramic ring 105 and forms an inert blanket around the metal being teemed.

In order to replace the ceramic ring 105 the housing 106 is simply detached from the tundish 101, inverted, and the ceramic ring 105 knocked out by tapping end 115. A new ceramic ring 105 is then inserted through opening 114 and is pushed into place by hand. As the ceramic ring 105 engages lips 107 and 113 it is compressed and forms a surprisingly effective seal which is enhanced when the apparatus 100 is clamped onto the bottom of the tundish 101.

Referring now to FIG. 3, the apparatus is generally similar to that shown in FIG. 2 except that the housing 206 is mounted on a movable launder or pivoting arm which can be swung into and out of the position shown as desired. In this embodiment the ceramic ring 205 extends both upwardly and downwardly from the housing 206. It will be noted that the flange 216 protects the top of the housing 206 from the molten metal as the movable launder or pivoting arm is moved into position.

Various modifications to the embodiment described are envisaged, for example the upper lip 113 could conceivably be dispensed with. In such an embodiment a seal would have to be formed between the underside of the tundish 101 and (a) the upper edge of the ceramic ring 105 and (b) the upper edge of the housing 111. It should be understood that such an embodiment is not preferred.

Whilst the present invention has been described in the context of teeming metal from a tundish to a mould it should be appreciated that it can be used in any context where molten metal is to be teemed from one vessel to another.

I claim:

1. An apparatus for shielding a stream of molten metal during teeming comprising in combination:

a generally cylindrical housing containing means to mount said housing to a tundish or ladle;

an upper inwardly projecting lip disposed within said housing having a central aperture with a circular opening therethrough;

a lower inwardly projecting lip disposed axially apart from said first lip, said second lip having a smaller central aperture with a circular opening axially aligned with the aperture in said first lip;

a truncated conically shaped compressible ceramic ring having a flange on the wider end, said flange projecting radially outward and adapted to be removably positioned in axial alignment with said housing in said apertures with said flange spaced above said upper lip, whereby when said ring is urged through said apertures, the surfaces of said apertures engage and compresses said ceramic to provide a generally gas tight annular shaped passage around said ring; and means to admit a gas to the annular shaped passage defined by said housing and said ring.

2. An apparatus according to claim 1 wherein said first and second apertures have tapered sides, said sides tapering toward the circular openings.

3. An apparatus as claimed in claim 1, wherein the wider end of said tapered ceramic ring is provided with a flange.

4. An apparatus for shielding a stream of molten metal during teeming comprising in combination:

a generally annular shaped housing having a first end and a second end closed by first and second inwardly radial projections having respectively axially aligned larger and smaller generally circular apertures therethrough;

a compressible ceramic ring in the shape of a truncated cone and having a flange on the wider end, said flange projecting radially outward and adapted to be removably positioned in axial alignment with said housing in said apertures with said flange spaced above said first inwardly radial projection, whereby when said ring is urged through said apertures, the surfaces of said apertures engage and compress said ring to provide a generally gas tight annular shaped passage around said ring; and means to admit a gas to the annular shaped passage defined by said housing and said ring.

5. An apparatus according to claim 4 wherein said first and second apertures have tapered sides said sides tapering toward the circular openings.

6. An apparatus as claimed in claim 4, wherein the wider end of said tapered ceramic ring is provided with a flange.

* * * * *